United States Patent [19]

Fritz

[11] 4,403,592

[45] Sep. 13, 1983

[54] ENGINE IGNITION SYSTEM WITH AUTOMATIC TIMING SHIFT

[75] Inventor: Adolf R. Fritz, Stuttgart, Fed. Rep. of Germany

[73] Assignee: Robert Bosch GmbH, Stuttgart, Fed. Rep. of Germany

[21] Appl. No.: 374,255

[22] Filed: May 3, 1982

[30] Foreign Application Priority Data

May 12, 1981 [DE] Fed. Rep. of Germany ..... 3118679

[51] Int. Cl.[3] ..... F02P 1/00

[52] U.S. Cl. ..... 123/609; 123/644

[58] Field of Search ..... 123/609, 610, 611, 644

[56] References Cited

U.S. PATENT DOCUMENTS

| | | | |
|---|---|---|---|
| 4,245,600 | 1/1981 | Katada | 123/611 |
| 4,265,204 | 5/1981 | Junot | 123/609 |
| 4,267,813 | 5/1981 | Hohne | 123/644 |
| 4,292,942 | 10/1981 | Katada | 123/609 |
| 4,305,370 | 12/1981 | Hohne | 123/609 |
| 4,356,808 | 11/1982 | Bodig | 123/609 |

*Primary Examiner*—Ronald B. Cox

*Attorney, Agent, or Firm*—Frishauf, Holtz, Goodman & Woodward

[57] ABSTRACT

In addition to a first storage circuit in which a sawtooth wave is generated for comparing the ramp voltage with a threshold voltage that is caused to vary with engine conditions, particularly engine speed, for determining when the interruptor switch of the primary circuit of an ignition coil is closed to begin buildup of current therein, an auxiliary storage circuit is provided for generating an auxiliary signal within the duration of which the sawtooth wave of the main charging circuit must return to its starting condition, and another pulse signal present during all but an initial portion of the auxiliary signal for rapidly returning that sawtooth wave to its beginning a new beginning, thus making a longer part of the ignition cycle available for variation of the duration of the period during which the interruptor switch is closed to allow buildup of current in the ignition coil.

8 Claims, 2 Drawing Figures

ENGINE IGNITION SYSTEM WITH AUTOMATIC TIMING SHIFT

This invention concerns an ignition system for an internal combustion engine, such as a motor vehicle engine of the kind comprising an ignition coil with primary and secondary windings, an interruptor switch in series with the primary winding, an engine driven timing generator controlling a switching path in its output to provide a signal from causing the interruptor switch to go from its conducting state into its blocking state to produce a spark in the engine, with the provision of an electric storage circuit for providing a sawtooth voltage which, when it rises to a threshold voltage, determines when the interruptor switch will be returned to its conducting condition for building up current in the ignition coil. In such circuits, the threshold voltage is modified by application of a regulating value that depends at least in part on engine speed to provide a suitable shift of the closing time for the interruptor switch.

An ignition system of this kind is known from German published patent application DE-OS No. 2 925 235. In this circuit, however, the return portion of the sawtooth wave stretches out over the entire period during which the switching path actuated by the timing generator remains in its condition established immediately after the moment of ignition. This has the disadvantage that with increasing engine speed, the time region over which the closing of the electronic interruptor can be advanced is relatively small.

SUMMARY OF THE INVENTION

It is an object of the present invention to improve an ignition circuit of the above-described kind so that a wider range of variability of the interval between opening and closing of the interruptor switch will be possible.

Briefly, an auxiliary electric storage circuit is provided for generating an auxiliary signal which begins with the switchover of a switching path controlled by the engine driven timing generator with a duration which is at least coextensive in time with the duration of the return part of the sawtooth wave of the main electric storage circuit, while at the same time causing a voltage change to take place in the auxiliary electric storage circuit. When the switching path controlled by the engine driven timing generator returns to its prespark condition, a voltage change in the opposite direction is then produced in the auxiliary storage circuit. Preferably the auxiliary signal thus provided is caused to terminate when a threshold value is reached by the first voltage change of the auxiliary storage circuit. Preferably the voltage continues to rise to a final value slightly higher than the threshold voltage. The termination of the auxiliary signal coincides with the termination of the return part of the sawtooth wave of the main storage circuit, but the auxiliary signal begins before the beginning of that return phase of the sawtooth wave. The quick return of the sawtooth wave that can thus be produced frees a larger part of the period between sparks for adjustment of the moment at which the interruptor switch is put into its conducting condition to enable buildup of enough energy in the ignition coil for another spark even at high speeds.

BRIEF DESCRIPTION OF THE DRAWINGS

The invention is further described by way of illustrative example with reference to the annexed drawings, in which.

DESCRIPTION OF THE ILLUSTRATED EMBODIMENT

Figure 1:
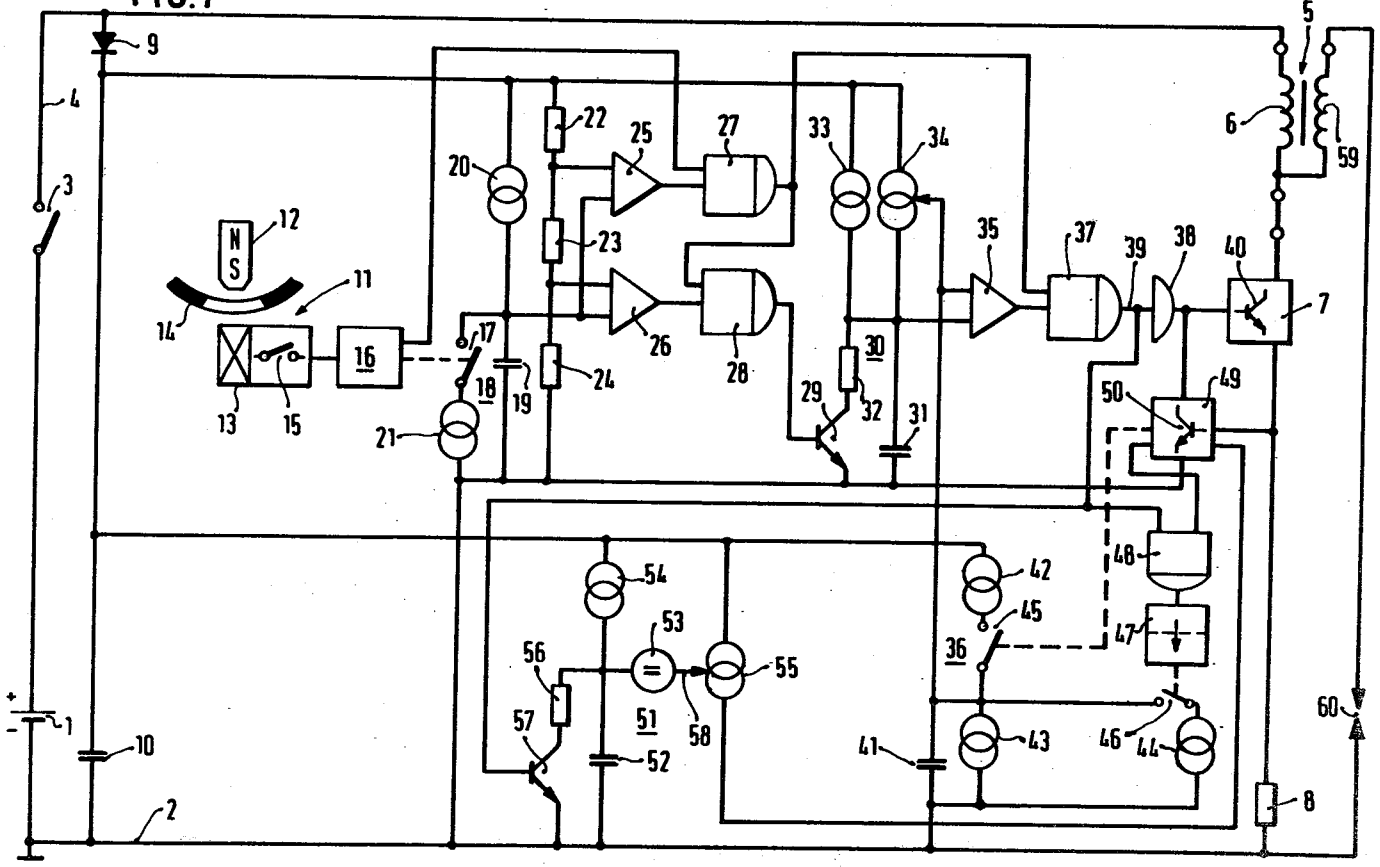
FIG. 1 is a circuit diagram of an ignition system according to the invention.

The ignition system represented in FIG. 1 is designed to serve an internal combustion engine (not shown) of a motor vehicle (likewise not shown). The ignition system is supplied with electrical energy from a d.c. current source 1, for example the motor vehicle battery. A ground or chassis line 2 runs from the negative pole of the current source 1 and a supply bus 4 runs from the positive pole of the current source to the operating switch (ignition switch) 3 and then to the ignition circuit proper, where there is a connection to a primary winding 6 belonging to an ignition coil 5. The other connection of the primary winding 6 goes, first through an electronic interruptor 7 and then through a measuring resistor 8, to a connection to the ground line 2. The positive voltage bus 4 also has a connection to the anode of a diode 9 provided for protection against false polarity, and from the cathode of that diode there is a connection to a buffer capacitor 10, the other electrode of which is connected to the ground line 2.

A signal generator 11, in the illustrated case a Hall generator, is provided for initiating the ignition process. The signal generator 11 accordingly has a permanent magnet 12 of which the magnetic effect on a Hall element 13 can be transiently set free and interrupted by a diaphragm 14 driven by the internal combustion engine and having an aperture for allowing the magnetic field to extend therethrough. In the moment in which the effect of the magnet freely passes through the diaphragm 13, a switching path 15, which in the illustrated case can be the emitter-collector path of a transistor (although it is not shown as such in the drawing) is brought into the conducting condition. When the Hall element 13 is again covered by the diaphragm 14, the switching path 15 goes into the blocking or non-conducting condition.

The signals generated by the switching path 15 are supplied to a control circuit 16 for operating a switch 17 (as indicated on the drawing by broken line). Although for simplicity this is shown in the drawing as involving the control of a mechanical switch, of course in practice it can and would be an emitter-collector path of another transistor controlled by the control circuit 16. The switching path 17 is a component of an auxiliary storage circuit 18 which includes a capacitor 19, a first constant current source 20 and a second constant current source 21. The capacitor 19 has one electrode connected to the ground line 2 and the other connected through the first constant current source 20 to the cathode of the protection diode 9. The second constant current source 21 forms with the switching path 17 a series circuit that is in shunt to the capacitor 19.

A series circuit of three resistors 22,23 and 24 is connected between the cathode of the protection diode 9 and the ground line 2. The connecting junction between the resistors 22 and 23, the former being the one which is connected to the protection diode 9, is connected to a first input of a first comparator 25 and the other junction of resistors of this series combination (resistors 23 and 24 in this case) is connected to a first input of a second comparator 26. The second input of the first comparator 25 and the second input of the second comparator 26 are both connected to the connection between the capacitor 19 and the first constant current source 20.

The first comparator 25 has its output connected to a first input of a first logic network 27, while the second comparator 26 has its output connected to a first input of a second logic network 28. The other input of the second logic network 28 is connected to the output of the first logic network 27, which has its second input connected back in turn to the output of the control circuit 16.

The output of the second logic network is connected to the base of an npn transistor 29, which belongs to the main storage unit 30 and there provides a discharge switch. Other components that belong to this main storage unit 30 are a capacitor 31, a resistor 32 and two more constant current sources 33 and 34. The capacitor 31 is connected at one terminal to the ground line 2 and at the other terminal to the constant current source 34 and through the latter to the cathode of the protection diode 9. The two constant current sources 33 and 34 are connected in parallel. The emitter-collector path of the transistor 29 forms, together with the resistor 32, a series circuit that is in shunt with the capacitor 31. The terminal of the capacitor 31 which is not grounded is, furthermore, connected to the input of a third comparator 35 which has its other input connected to an integrator 36. The output of the third comparator 35 is connected to one input of a third logic network 37 that has a second input connected to the output of the first logic network 27. The output of the third logic network 37 is connected to a control line 39 that contains a blocking device 38, over to the control input of the electronic interruptor 7 which is constituted by at least one transistor 40.

The integrator 36 serves to produce a regulation value and for this purpose has a capacitor 41, and first, second and third constant current sources 42,43 and 44, as well as a switching path 45 and a switching path 46. The capacitor 41 has one of its terminals connected to the ground line 2 and the other of its terminals connected both to the input not yet mentioned of the comparator 35 and also to a control connection of the constant current source 34.

A connection running from the cathode of the protection diode 9 goes, first, through the constant current source 42 and then through the switching path 45 and finally through the second constant current source 43 of the integrator 36 to the ground line 2, so that the constant current source 43 is in shunt with the capacitor 41. The third constant current source 44 of the integrator 36 forms with the switching path 46 a series circuit which, from a circuit point of view, is also in shunt with the capacitor 41. The switching path 46 belongs, as indicated by a broken line, to a delay circuit 47 and can in practice be formed by the emitter-collector path of a transistor. The delay circuit 47 (which may be a monostable multivibrator) has an input connected to an output of a fourth logic network 48 that has one input connected to the output of the third logic network 37 and its other input connected to the output of a current-limiting circuit 49.

The current-limiting circuit 49 that in practical application is likewise a transistorized circuit, has its control input connected to the connection between the electronic interruptor 7 and the measuring resistor 80. The current-limiting circuit 49 also has a regulating path illustrated by the representation 50 of a transistor that lies circuitwise between the control input of the electronic interruptor 7 and the ground line 2. A broken line from the switch 45 to the current-limiting circuit 49 further indicates a correlation of these two units which in practice is performed by the emitter-collector path of still another transistor (not shown).

The protective subcircuit 51 is provided so that the ignition coil 5 will not be overheated or damaged when current flows continuously through the primary winding 6 after the ignition switch 3 is turned on and the engine for some reason or other remains at rest. This protective subcircuit 51 comprises a capacitor 52, a reference voltage source 53 having a threshold value function, a first constant current source 54, a second constant current source 55 which is controllable by the reference voltage source 53, a discharge resistor 56 and a discharging transistor 57. The base of the discharging transistor 57 is connected with the output of the third logic network 37 and series circuit composed of its emitter-collector path, and the resistor 56 is put in shunt with the capacitor 52. The capacitor 52 has one of its terminals connected to the ground line 2 and the other of its terminals connected through the first constant current source 54 to the cathode of the protection diode 9. The connection provided between the capacitor 52, and the first constant current source 54 is also connected to the input of the reference voltage source 53, which is operatively connected through a control connection 58 to the second constant current source 55. The constant current source 55 is interposed into a connection leading from the protection diode 9 to the input of the current-limiting circuit 49.

The secondary winding 59 belonging to the ignition coil 5 has a connection leading through a sparkplug 60 to the ground line 2.

OPERATION OF THE CIRCUIT

Figure 2:
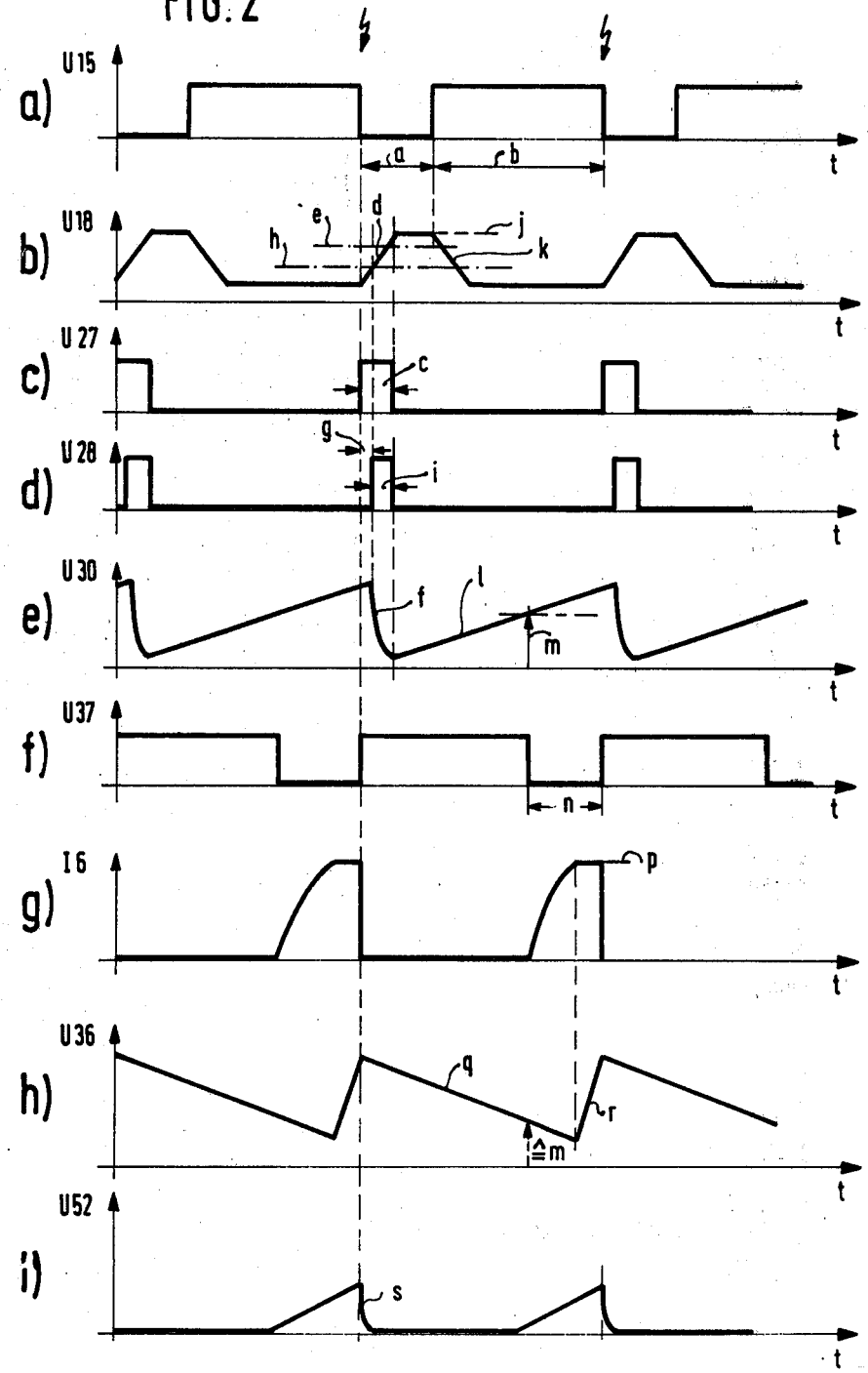
FIG. 2 is a timing diagram for explaining the operation of the circuit of FIG. 1 constituted of an array of graphs to the same time scale, each graph of the array pertaining to an electrical magnitude observable at a different point in the circuit and being designated at the left respectively (a), (b), (c), . . . for ready reference thereto.

As soon as the ignition switch 3 is closed, the ignition system is ready to function. In the line (a) in FIG. 2, which is a plot of the voltage U15 against the time t, it is shown that the conducting condition of the switching path 15 extends over the time period a, while the blocking condition of the switching path 15 extends over the time segment b. A transition of the switching path 15 is intended to determine the moment of ignition, as indicated in FIG. 2 by a "lightning" arrow at the top of the diagram. As the result of the transition of the switching path 15 into the conducting condition, an auxiliary signal c is produced at the output of the logic network 27 by a command produced by the control circuit 16. The signal c is shown in line (c) of FIG. 2 which plots the voltage U27 against time. At the same time, the switching path 17 is put into the blocking condition as the switching path 15 goes into the conducting state, with the result that a first change d takes place in the auxiliary storage circuit 18, as shown in line (b) of FIG. 2, which plots the voltage U18 against time. This first change of the stored voltage in the storage circuit 18 is brought about by a charging-up of the capacitor 19 by the first constant current source 20 as the result of the blocking condition of the switching path 17.

If now in the auxiliary storage circuit 18 the first voltage change d of the stored voltage reaches a reference level e, the auxiliary signal c is terminated. This is accomplished by the comparator 25 which compares the voltage of the capacitor 19 at one input with the steady voltage at the junction of the resistors 23 and 24. When these voltages become the same, a signal is provided to the first logic network 27 for terminating the auxiliary signal c. Within the period of time during which the auxiliary signal is present there takes place the first change f of the voltage stored in the main storage circuit 30. This change f is shown in line (e) of FIG. 2 which plots the voltage U30 against time. The change f of the electric charge stored in the main storage circuit 30 should take place in a relatively short period in order to avoid giving disturbing pulses much opportunity to falsify it, and thereby also erroneously determine the time during which the current is supplied to the primary winding 6 for the generation of an effective ignition spark. For this reason, the first change f of the voltage stored in the main storage circuit 30 is not initiated with the switchover of the switching path 15 into the conducting condition, but rather a little later after the lapse of the small time period g shown in FIG. 2. This result is obtained by initiating the first change f of the voltage stored in the main storage circuit 30 only when the first change d in the voltage of the auxiliary storage circuit 18 has reached a comparison voltage h illustrated in line (b) of FIG. 2. This operation is performed by the second comparator 26 which compares the voltage at the capacitor 19 with the voltage drop across the resistor 24, and when these are the same causes the logic network 28 to make available a pulse i, illustrated in line (d) of FIG. 2, which causes the discharge of capacitor 31 in the main storage circuit 30 to produce the first change f of the voltage there stored. The emitter-collector path of the transistor 29 is then put into its conducting condition, starting the discharge of the capacitor 31 over the resistor 32, overcoming the continuous charging-up of the capacitor by the constant current sources 33 and 34, thus producing the aforesaid voltage change f.

In order to prevent so far as possible any impairment of the above-described events by disturbing pulses, the final voltage state j reached at the end of the change d of the voltage in the auxiliary storage circuit 18 is chosen to be somewhat higher than the reference voltage e, as illustrated in line (b) of FIG. 2.

By the connection of the output of the first logic network 27 with the input of the third logic network 37, it is assured that the electronic interruptor 7 remains in its blocking condiction during the presence of the auxiliary signal c, so that even at high engine speeds, sufficient time is provided for the building up of energy in the ignition coil 5 to produce an effective ignition spark. In this connection, it is desirable to cause the duration of the auxiliary signal c to vary somewhat in inverse proportion to the level of the supply voltage, in order to maintain a sufficient period of time for the building up of the ignition spark energy, even when the supply voltage falls below normal. This function can be performed by providing for the current flowing through the first constant current source 20 a difference dependence on the voltage supply than the dependence that applies to the voltage drop across the resistances 23 and 24.

The switchover of the switching path 15 of the signal generator 11 into the blocking condition is utilized to switch the switching path 17 into the conducting condition, so that the capacitor 19 can be discharged through the second constant current source 21 and a second change k of the auxiliary storage circuit voltage may be produced, as shown in line (b) of FIG. 2. In this case the discharge of the capacitor 19 again outweighs the charging that takes place continuously by the operation of the first constant current source 20.

The termination of the auxiliary signal c has the result, through the connection of the output of the first logic network 27 with the input of the second logic network 28, of terminating also the impulse i. This means that the emitter-collector path of the transistor 29 is put into the blocking condition and thereafter a charging up of the capacitor 31 takes place through the constant current sources 33 and 34, which is here designated as the second change l of the voltage stored in the main storage circuit 30, illustrated in line (e) of FIG. 2. When this second change l reaches the voltage level m, at a time following the termination of the auxiliary signal c, the third comparator 35 causes the third logic network 37 to provide a pulse n which is shown on line (f) of FIG. 2 where the voltage U37 is plotted against time. The pulse n, acting over the line 39, causes the electronic interruptor 7 to be switched over into its conducting condition. A current then begins to flow in the primary winding 6, the buildup of which is illustrated in line (g) of FIG. 2 which plots the current I6 against time. When the current in the primary winding 6 reaches a value p, which is fully sufficient for an effective ignition spark, the current-limiting circuit 49 comes into action as the voltage across the measuring resistance 8 rises high enough to make the regulating path 50 conducting to divert therethrough just enough control current from the control electrode of the interruptor switch 7 to maintain the current magnitude p in the primary winding 6.

The stored voltage level m defines a regulating value which is established by the integration value in the integrator 36. This is carried out by having the capacitor 41 normally discharged through the constant current source 43 and thereby causing the integrator 36 continuously to integrate downwards on a course designated q in the plot of the voltage U36 against time illustrated in line (h) of FIG. 2.

When the current value p is reached in the primary winding 6, as shown in line (g) of FIG. 2, the current-limiting circuit 49 brings its switching path 45 into the conducting condition, so that now a charging-up of the capacitor 43 through the first constant current source 42, and thereby an upwards integration r of the integrator 36 are produced. Downwards integration q and upward integration r are variable at least in part, in accordance with the engine speed, so that with increasing speed of the engine, the threshold voltage m (line (e) of FIG. 2) becomes smaller, and the switching over of the electronic interruptor 7 takes place earlier, so that even at high speed, a sufficient duration of the pulse n will be maintained for the flow of current in the primary winding 6. It has been found advantageous in this connection to vary the current flowing through the second constant current source 34 in a manner inversely proportional to the regulating value, i.e., to the integrated value present in the integrator 36, because in this manner the rise of the second voltage change 1 of the main storage circuit 30 is magnified, so that even at high engine speed a satisfactory switching function is still maintained.

At the moment of ignition, as the result of the switching over of the switching path 15 of the signal generator 11 into its conducting condition, as well as as the result of the connection of the control unit 16 with the input of the first logic network 27 and the connection of the output of the first logic network 27 with the input of the third logic network 37, the electronic interruptor 7 is brought into its blocking condition. The interruption of the current in the primary winding 6 then induces a very high voltage pulse in the secondary winding 59 which produces an electrical breakdown (ignition spark) in the sparkplug 60.

If, after the switching over of the electronic interruptor 7 into its conducting condition, the current strength p is not reached, for example on account of rapid acceleration in the low-speed region of the engine, the fourth logic network 48 turns on the timing circuit 47, which puts the switching path 46 into the conducting condition and causes the third constant current source 44 of the integrator 36 to be put in parallel with the second constant current source 43 thereof, producing a heavier downward integration q in the integrator 36. This has the result that the threshold voltage value m is reached sooner during the second change l of the voltage stored in the main storage circuit 30, thus providing some prolongation of the pulse m. In this manner, it is assured that the current magnitude p will again be obtained.

Finally, for the case in which the ignition system is switched on but for some reason the engine is not started, so that continuing current through the electronic interruptor 7 and the primary winding 6 would flow, overheating the ignition coil 5 or even destroying it, a protective circuit 51 is provided. When the engine is stopped while the ignition circuit is turned on, the emitter-collector path of the transistor 57 is not any longer put into its blocking condition and the capacitor 52 which can be charged up by the first constant current source 54 no longer goes through a discharge s, such as is shown in line (i) of FIG. 2 which plots the voltage U52 against time. The reference voltage source 53 is thereby caused to control the second constant current source 55 in such a way that it delivers increasing current to the input of the current-limiting circuit 49. In response thereto, the current-limiting circuit 49 increasingly diverts control current from the control electrode of the electronic interruptor 7 and gradually puts the latter into its blocked condition.

Although the invention has been described with reference to an illustrative example, it will be understood that variations and modifications are possible within the inventive concept.

Reference is made to the book "RCA-integratet circuits" Copyright 1967 by Radio Corporation of America, pages 28 and 53, for the constitution of constant current sink (or source) for use in circuits those of FIG. 1.

I claim:

1. An ignition system for an internal combustion engine comprising an ignition coil (5) having primary and secondary windings, an interruptor switch (7) having its switching path in series with said primary winding and a source of voltage, means including an engine-driven generator (11) and a switching path (15) controllable by said generator for causing the switching path of said interruptor switch (7) to go from its conducting state into its blocking state at an ignition instant suitable for producing a spark in a circuit connected to said secondary winding, and a main electric storage circuit (30) for providing a first control voltage acting after said ignition initiation by said switching path (15) controlled by said generator (11) for timing return of said path of said interruptor switch to a conducting condition in a manner utilizing in alternation a first voltage change (f) in one direction and a second voltage change (l) more gradual than the first and in the opposite direction, and means responsive to said control voltage reaching a first threshold value (m) in the course of said second voltage change (1) for causing a change of the condition of said interruptor switch path to a conducting condition, as well as means for modifying said first threshold voltage (m) by application of a regulating value (q) dependent at least in part on the engine speed, said ignition system further comprising, in accordance with the invention:

an auxiliary electric storage circuit (18) for providing a second control voltage acting after said ignition initiation by said switching path (15) controlled by said generator (11), including means for generating an auxiliary signal (c) beginning at the moment of said ignition initiation and having a signal duration which is at least coextensive in time with the duration of said first voltage change (f) of said main electric storage circuit (30), and at the same time causing a first voltage change (d) to take place in said auxiliary electric storage circuit (18), said first voltage change (d) being followed by a second voltage change in the opposite direction, the beginning of which is timed by the return to a conducting state of said switching path (15) under control of said generator (11).

2. An ignition system as defined in claim 1, in which said means for generating an auxiliary signal (c) is constituted so as to terminate said auxiliary signal (c) when said first voltage change (d) of said auxiliary electric storage circuit (18) causes said second control voltage to reach a reference value (e).

3. An ignition system as defined in claim 2, in which said auxiliary electric storage circuit (18) is constituted so as to cause said first voltage change (d) of said second control voltage to reach a final value (j) for storage in said auxiliary electric storage circuit (18) that is higher than said reference voltage (e).

4. An ignition system as defined in claim 1, in which said means for generating said auxiliary signal (c) included in said auxiliary electric storage circuit (18) is constituted so as to cause said auxiliary signal (c) to begin before the beginning of said first voltage change (f) of said main electric storage circuit (30) and to terminate simultaneously with the ending of said first voltage change (f) of said main electric storage circuit (30).

5. An ignition system as defined in claim 4, including means for causing the duration of said auxiliary signal (c) to vary in a manner inversely proportional to the supply voltage provided to said ignition system.

6. An ignition system as defined in claim 4, in which said means for modifying said first threshold voltage (m), by application of a regulating value (q), is constituted as means for varying said first threshold voltage (m) inversely proportional to said regulating value (q).

7. An ignition system as defined in claim 6, in which means are provided for producing a change in the value of said regulating value (q) when the current strength in said primary winding (6) of said ignition coil (5) is below a predetermined threshold value, the switching-over of said interruptor switch into its conducting state will be advanced in time.

8. An ignition system as defined in claim 1, in which protective circuit means (51) are provided for preventing damage by continuous flow of current in said primary winding (6) of said ignition coil (5) when said engine remains in stopped condition.

* * * * *